US009899204B2

(12) United States Patent
Bailey

(10) Patent No.: US 9,899,204 B2
(45) Date of Patent: Feb. 20, 2018

(54) MASS SPECTROMETRY ANALYSIS OF BIOMOLECULES BY MULTIPLE CHARGE STATE SELECTION USING A CONCURRENT PRECURSOR ISOLATION TECHNIQUE

(71) Applicant: Thermo Finnigan LLC, San Jose, CA (US)

(72) Inventor: Aaron O. Bailey, Santa Cruz, CA (US)

(73) Assignee: Thermo Finnigan LLC, San Jose, CA (US)

( * ) Notice: Subject to any disclaimer, the term of this patent is extended or adjusted under 35 U.S.C. 154(b) by 0 days.

(21) Appl. No.: 15/172,628

(22) Filed: Jun. 3, 2016

(65) Prior Publication Data

US 2017/0352529 A1 Dec. 7, 2017

(51) Int. Cl.

*H01J 49/26* (2006.01)
*H01J 49/42* (2006.01)
*H01J 49/00* (2006.01)

(52) U.S. Cl.

CPC ..... *H01J 49/4215* (2013.01); *H01J 49/004* (2013.01)

(58) Field of Classification Search

CPC ..... H01J 49/4215; H01J 49/004
USPC ..... 250/281, 282, 283, 288
See application file for complete search history.

(56) References Cited

U.S. PATENT DOCUMENTS 9,048,074 B2 6/2015 Senko
2005/0199804 A1* 9/2005 Hunt ..... G01N 33/6848 250/290
2014/0339421 A1* 11/2014 Senko ..... H01J 49/0081 250/283
2014/0349871 A1* 11/2014 Bruce ..... G01N 33/6848 506/9

OTHER PUBLICATIONS

Senko et al., "Collisional Activation of Large Multiply Charged Ions Using Fourier Transform Mass Spectrometry," Anal. Chem. 1994, 66, 2801-2808.

* cited by examiner

*Primary Examiner* — Nicole Ippolito
(74) *Attorney, Agent, or Firm* — Nicholas Cairns

(57) ABSTRACT

A method is described for the analysis of biological polymers, for example, intact proteins or oligonucleotides, by mass spectrometry. This method produces sample ions from a sample containing biological polymers, and ion species are selected that correspond to different charge states of a biological polymer molecule. The ion species are concurrently isolated from the sample ions to generate precursor ions in an ion trap mass spectrometer or in a quadrupole mass filter mass spectrometer. Precursor ions or product ions derived from the precursor ions may then be mass analyzed. The mass analysis step may include fragmenting the precursor ions to form product ions.

19 Claims, 2 Drawing Sheets

Figure 1:
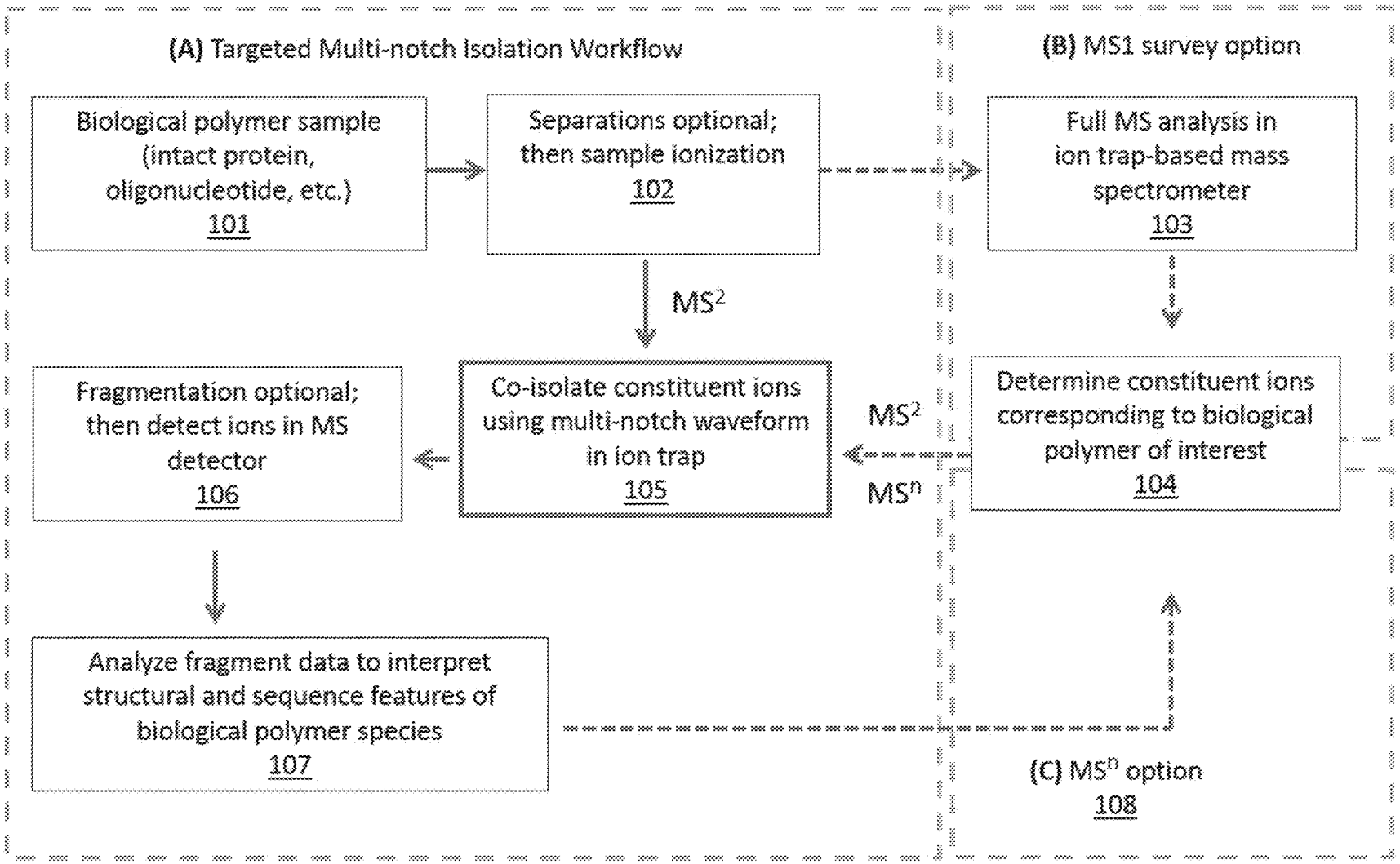

Relative Abundance
100
80
60
40
20
0
1000
1200
1400
1600
1800
2000
m/z

MASS SPECTROMETRY ANALYSIS OF BIOMOLECULES BY MULTIPLE CHARGE STATE SELECTION USING A CONCURRENT PRECURSOR ISOLATION TECHNIQUE

TECHNICAL FIELD OF THE INVENTION

This invention relates generally to the analysis of large molecules by mass spectrometry, and more specifically to concurrent isolation methods of multiple charge states in mass spectrometry analysis.

BACKGROUND TO THE INVENTION

Mass spectrometry (MS) has become a method of choice for fast and efficient identification of many types of larger molecules and molecular constructs including proteins, oligonucleotides, carbohydrates, monodispersed polyethylene glycols, etc. In general, a mass spectrometer comprises an ion source for generating ions from molecules to be analyzed, and ion optics for guiding the ions to a mass analyzer. A tandem mass spectrometer further comprises the ability to perform a second or further stages of mass analysis. This is typically referred to as $MS^n$ where the "n" superscript denotes the number of generations of ions. Optional separation or partial separation of analyte components prior to MS analysis may be achieved by liquid chromatography (LC), high performance liquid chromatography (HPLC) or ultra performance liquid chromatography (UPLC).

It is well-known in the art that biological polymers (i.e., intact proteins, oligonucleotides, etc.) subjected to electrospray ionization mass spectrometry give rise to broad distributions of ion charge states. Each of these charge states physically represents a fraction of the total distribution of ion signals correlating to that particular biological polymer species. By operating the mass spectrometer in full MS1 mode, a distribution of ions (mass-to-charge ratio, m/z) for a biological polymer species (mass) can be observed.

The charge state of a particular constituent ion may be unambiguously calculated by using m/z values of sequential charge state ions as in Equation 1, where H represents a proton (for positive ion mass spectrometry):

$$z_2=(m_1/z_1-H)/(m_2/z_2-m_1/z_1) \quad \text{Equation 1:}$$

Where $z_1$ and $z_2$ are consecutive charges states ($z_1$ is a higher charge state than $z_2$); $m_1/z_1$ and $m_2/z_2$ are their respective m/z values and H is approximately 1.0 (Fenn, U.S. Pat. No. 5,130,538A).

A species' mass (M) can then be determined by using the calculated charge state value of that ion and the observed m/z value (Equation 2):

$$M=z(m/z-H) \quad \text{Equation 2:}$$

A charge state deconvolution algorithm may be utilized to simultaneously determine the entire spectrum of parent masses and constituent ion charge states for complex mass spectra involving multiple charge state distributions deriving from multiple parent species.

Due to well-known isotope effects, in general, the higher the molecular weight of an analyte in mass spectrometry, the broader the isotopic cluster will be in each charge state, and the more charge states the species will display. This results in a significant "dilution" of the analyte signal over these multiple charges states. Conventional serial isolation events especially in tandem mass spectrometry represent a bottleneck in the process of generating high quality tandem mass spectra. Methods of co-isolation or "multi-notch" isolation in mass spectrometry has been described previously (for example, see Senko, U.S. Pat. No. 9,048,074 B2 and cited references therein, incorporated herein in its entirety). Against the above background there remains a need for improving signal capture (relative abundance) of precursor and product ions in mass spectral analysis mass methods that involve larger analytes that show multiple charge states.

SUMMARY OF THE INVENTION

A method is described for the analysis of biological polymers, for example, intact proteins or oligonucleotides, by mass spectrometry. This method produces sample ions from a sample containing biological polymers, and ion species are selected that correspond to different charge states of a biological polymer molecule. The ion species are concurrently isolated from the sample ions to generate precursor ions in an ion trap mass spectrometer or in a quadrupole mass filter mass spectrometer. Precursor ions or product ions derived from the precursor ions may then be mass analyzed. The mass analysis step may include fragmenting the precursor ions to form product ions. The ion species in general may correspond to at least three different charge states of the biological polymer molecule. Alternatively, the ion species may correspond to at least four or five different charge states of the biological polymer molecule.

Isolation of ion species may comprise applying a multi-notch isolation waveform to electrodes of an ion trap or applying an isolation waveform to electrodes of a quadrupole mass filter. The step of selecting the ion species may include acquiring a mass spectrum of the sample ions to identify ion species in the mass spectrum corresponding to a biological polymer molecule of interest. The step of concurrently isolating the ion species may include setting isolation windows of sufficient width to isolate multiple isotopic forms of each ion species. The step of selecting ion species may further include, determining, for each of the candidate ion species, whether an interfering ion species is present within a separation window and selecting from these ion species only those of the candidate ion species for which an interfering species is not present in order to give a cleaner, more accurate quantitation measurement for the desired ion species. The fragmentation step may performed using a dissociation method, and wherein the step of selecting ion species includes selecting at least a first and a second ion species, the first and second ion species having substantially different dissociation characteristics from each other with respect to the dissociation method. The dissociation method above may be selected from a variety of common mass spectrometry dissociation methods including electron transfer dissociation. The step of mass analysis may comprise isolating at least one ion species of the product ions to generate MS3 (MS/MS/MS) precursor ions and fragmenting the MS3 precursor ions to form MS3 product ions and then mass analyzing the MS3 product ions.

The method described herein may use a mass spectrometer optionally containing an ion fragmenter for producing product ions by dissociation of the precursor ions. The mass spectrometer may include an ion source for generating sample ions from a sample, an ion trap or quadrupole mass filter ion isolator configured to concurrently isolate multiple ion species of the sample ions to generate precursor ions. It may also include a mass analyzer for mass analyzing the precursor ions or product ions derived therefrom and a controller, coupled to the ion isolator, adapted to select ion species corresponding to different charge states of a biological polymer molecule in the sample, and to cause the ion isolator to concurrently isolate the selected ion species. The ion trap or quadrupole ion isolator may comprise an isolation waveform generator for applying a multi-notch isolation waveform to one or more electrodes of the ion trap or quadrupole in the mass spectrometer.

BRIEF DESCRIPTIONS OF THE DRAWINGS

The drawings, described below, are for illustration purposes only, they are not intended to limit the scope of the present teachings in any way.

FIG. 1 is a flowchart illustrating an example of a method of using co-isolated constituent ions in mass spectral analysis.

Figures 2A, 2B, 2C:
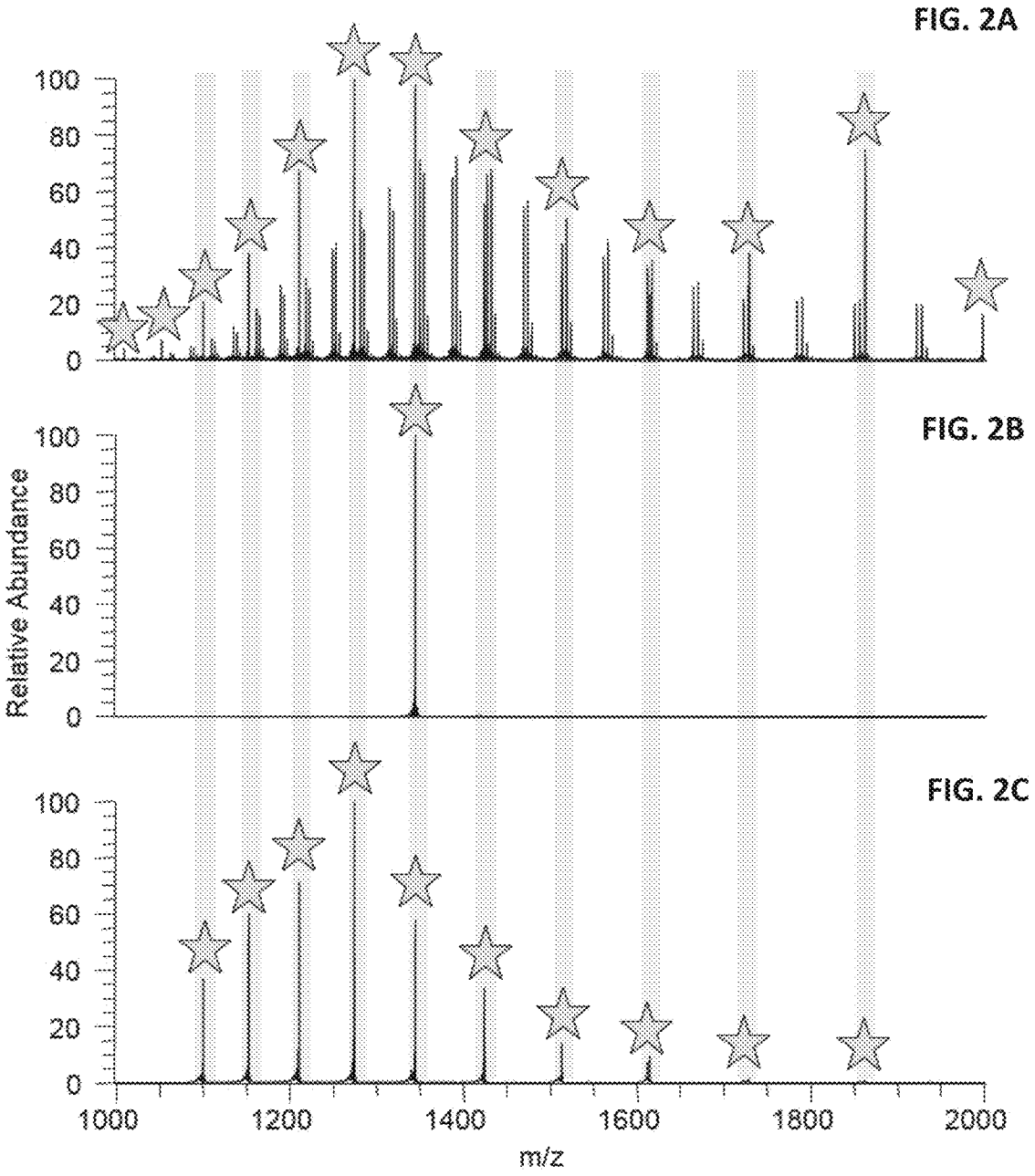

FIGS. 2A-C: FIG. 2A shows a full scan spectrum of an antibody light chain. FIG. 2B shows a single m/z isolation and FIG. 2C shows the co-isolation of multiple m/z peaks.

DETAILED DESCRIPTION

The following description is presented to enable a person skilled in the art to make and/or use the invention. Various modifications to the described embodiments herein will be readily apparent to those skilled in the art and the generic principles can be applied to other embodiments. Thus, the present invention is not intended to be limited to the embodiments and examples shown but is to be given its widest possible scope in accordance with the features and principles shown and described. The particular features and advantages of the invention will become more apparent with reference to the appended figures, taken in conjunction with the following description. The term protein(s) as used herein may also refer to polypeptide(s) and peptide(s), all terms being well-known in the art.

In general, the higher the molecular weight (MW) of an analyte in mass spectrometry (MS), the broader the MS peaks comprising a given isotopic cluster, due to the distribution of naturally occurring isotope effects. Also, the higher the MW of a species, the more charge states will be displayed, particularly under relatively mild ionizing conditions such as in ESI MS or as in atmospheric pressure chemical ionization (APCI) MS. The more charge states that a molecular species or construct displays, the more "diluted" the original signal becomes as the signal may be spread out over a larger number of charge states. Some embodiments of the present invention utilize broadband waveforms that simultaneously isolate a plurality of small mass to charge ratio (m/z) windows where each m/z window may contain a single charge state for a particular species (this may be referred to as "multi-notch" analysis). Summing the intensities or areas of multiple peaks that represent individual charge states for a particular species translates into a substantially higher signal detection and sensitivity when compared to the intensity or area of a single charge state peak.

An embodiment of the present invention utilizing targeted $MS^2$-level selection of a priori known ions for subsequent fragmentation is shown in FIG. 1(A). In steps 101 and 102 a biological polymer sample (for example, an intact protein or oligonucleotide) is optionally separated (for example, by reverse phase HPLC or UPLC) before undergoing ionization and introduction into the mass spectrometer. In step 103 a MS full scan can optionally be used to survey or verify which ions are present concurrently as shown in FIG. 1(B). A list of known ions determined in step 104 can be co-isolated using a multi-notch isolation waveform in step 105, these ions may be sent directly to the detector (selected ion monitoring) or optionally fragmented, for example, by collision induced dissociation (CID), electron transfer dissociation (ETD) or by ultraviolet photo-dissociation (UVPD), and resulting ions detected in a MS detector in step 106 and mass analyzed in step 107. Multi-level $MS^n$ analysis may be performed by identifying specific ions with this resulting fragmentation product ion mixture to be targeted for a subsequent round of tandem mass spectrometry analysis as shown in FIG. 1(C) 108. As quadrupole mass filters can also concurrently isolate selected m/z regions using broadband waveforms, one skilled in the art would recognize that they could be substituted for the ion trap in the above method. In the quadrupole mass filter, ions would not be trapped but would be isolated concurrently from background or other undesirable ions.

FIG. 2A shows a full scan MS trace without LC separation of an intact antibody light chain where the peaks with stars above them represent sequentially increasing charge states from right to left, together with other "impurity" peaks in between them, in this case, substantially composed of intact heavy chain antibody fragments carrying varying degrees of glycosylation post translational modifications (PTM). Conventionally, quantitation of an antibody light chain such as the one above would entail the isolation and quantitative analysis of only a single charge state as shown in FIG. 2B. Clearly, it would be highly advantageous to analyze a plurality of the starred peaks concurrently rather than just a single peak. Embodiments of the present invention achieve this advantage by using a multi-notch analysis approach as shown in FIG. 2C. One skilled in the art would recognize that when using a multi-notch approach, different m/z values may have different efficiencies for isolation, for example, the starred peak second from the right in FIG. 2A translates into a peak of relatively low intensity in FIG. 2C, however, this effect can easily be optimized for quantitation, or accounted for by limiting the set of isolation windows to all fall within a certain mass range, for example a factor of 1.5×. This loss in isolation resolution of the higher m/z ions is due to the lower rate of frequency change per unit m/z of the ions at high m/z.

An embodiment of the present invention involves concurrently isolating a set of $MS^n$ fragments from individual charge states that subsequently may be quantitatively or qualitatively mass analyzed. Subsequent mass analysis may be achieved directly from the ion trap device or may be achieved by routing the ions to a downstream MS analyzer, for example, a quadrupole, ion trap, electrostatic ion trap (for example, an ORBITRAP™) and time of flight (TOF) analyzer.

The selection of ion species from biological polymer sample ions involves selecting a plurality of different charge states. The selection may involve selecting at least three different charge states or it may involve selecting at least four different charge states or it may involve selecting at least five or more different charge states. Selection of sample ions may include acquiring a mass spectrum (or mass spectra) of the sample ions, and identifying ion species in the mass spectrum that correspond to a biological polymer molecule of interest.

Concurrent isolation of a plurality of ion species may include setting isolation window widths to isolate isotopic forms of each ion species. It may also include setting window widths that includes a plurality of ion species derived from the isotopic labeling or tagging of a single analyte biological polymer of interest.

Concurrent isolation of a plurality of ion species may include setting isolation window widths that vary as a function of m/z, so that higher m/z species maintain a certain desired isolation efficiency. It may also include setting window positions that vary as a function of the estimated number of ions in and about the isolation window(s), to account for space charge effects.

Multi-notch simultaneous isolation of multiple species has been successfully applied in the case of quadrupole mass filters. In this case, the isolation process took place in a matter of tens of microseconds, as the ions traversed the filter, which may somewhat limit the resolution, mass range and/or efficiency achieved with this technique. Nevertheless, sufficient performance was achieved, with the significant advantages of speed and resistance to ion-ion interactions, the last of which is the bane of all ion trapping based manipulations.

Co-isolation of multiple ions using a multi-notch waveform does not require that ions be sequentially consecutive. The choice of ions can reflect distinct strategies for the intended type of tandem MS experiment. For instance, one could target isolation of ions which are simply the highest in abundance in order to attain higher ion current per unit time. Such a strategy could be augmented, for example, by targeting only those high abundance ions which have sufficient m/z separation from interfering species, in order to optimize for precursor purity.

Alternatively, one could target isolation of ions which represent distinct charge state or structural forms that confer differential characteristics in reactivity to fragmentation. Under certain fragmentation conditions reactivity of a species may change with respect to charge state value; this phenomenon may be exploited to influence generation of different product fragment masses. Electron transfer dissociation and collisional dissociation techniques are subject to this manner of charge state bias (See Compton, P. D., Strukl, J. V., Bai, D. L., Shabanowitz, J., and Hunt, D. F. (2012) *Optimization of electron transfer dissociation via informed selection of reagents and operating parameters. Anal Chem* 84, 1781-1785; Zhang, J., Ogorzalek Loo, R. R., and Loo, J. A. (2015) *Increasing Fragmentation of Disulfide-Bonded Proteins for Top-Down Mass Spectrometry by Supercharging. Int J Mass Spectrom* 377, 546-556; and, Reid, G. E., Wu, J., Chrisman, P. A., Wells, J. M., and McLuckey, S. A. (2001) *Charge-state-dependent sequence analysis of protonated ubiquitin ions via ion trap tandem mass spectrometry. Anal Chem* 73, 3274-3281). Higher charge states are relatively more reactive than lower charge states to ETD as well as collisional fragmentation events such as HCD and CID. It would be possible to co-isolate one or more high charge states with one or more distinctly lower charge states to achieve a rich mixture containing products of reactions which have been driven to greater and lesser extents. Selecting multiple distinct sets of precursor ions could allow high reactivity- and low reactivity-ions to undergo fragmentation simultaneously, which would yield a broadened range of resulting product ion masses.

A list of known parent ions can be co-isolated using a multi-notch isolation waveform and may be directly sent to the detector (selected ion monitoring) or optionally fragmented (tandem mass spectrometry) and then the resulting ions are detected in the mass spectrometer detector. Additional levels of $MS^n$ analysis can be performed by identifying specific ions with the resulting fragmentation product ion mixture to be targeted for a subsequent round of tandem mass spectrometry analysis.

The present invention has been described in terms of specific embodiments incorporating details to facilitate the understanding of principles of construction and operation of the invention. Such reference herein to specific embodiments and details thereof is not intended to limit the scope of the claims appended hereto. It will be readily apparent to one skilled in the art that various other modifications may be made in the embodiment chosen for illustration without departing from the spirit and scope of the invention as defined by the claims.

What is claimed is:

1. A method for analysis of biological polymers by mass spectrometry, comprising:

producing sample ions from a sample containing biological polymers;

selecting a plurality of ion species corresponding to different charge states of a single biological polymer molecule;

concurrently isolating the plurality of ion species from the sample ions to generate precursor ions in an ion trap mass spectrometer or in a quadrupole mass filter mass spectrometer; and, mass analyzing the precursor ions or mass analyzing product ions from the precursor ions.

2. The method of claim 1, wherein the mass analyzing step comprises fragmenting the precursor ions to form product ions.

3. The method of claim 2, wherein the fragmenting step is performed using a dissociation method, and wherein the step of selecting the plurality of ion species includes selecting at least a first and a second ion species, the first and second ion species having substantially different dissociation characteristics from each other with respect to the dissociation method.

4. The method of claim 3, wherein the dissociation method is electron transfer dissociation.

5. The method of claim 2, wherein the step of mass analyzing comprises:

isolating at least one ion species of the product ions to generate MS3 precursor ions; and fragmenting the MS3 precursor ions to form MS3 product ions; and mass analyzing the MS3 product ions.

6. The method of claim 1, wherein the plurality of ion species correspond to at least three different charge states of the single biological polymer molecule.

7. The method of claim 1, wherein the plurality of ion species correspond to at least four different charge states of the single biological polymer molecule.

8. The method of claim 1, wherein the plurality of ion species correspond to at least five different charge states of the single biological polymer molecule.

9. The method of claim 1, wherein the step of concurrently isolating the plurality of ion species comprises applying a multi-notch isolation waveform to electrodes of an ion trap.

10. The method of claim 1, wherein the step of concurrently isolating the plurality of ion species comprises applying an isolation waveform to electrodes of a quadrupole mass filter.

11. The method of claim 1, wherein the step of selecting the plurality of ion species includes acquiring a mass spectrum of the sample ions, and identifying ion species in the mass spectrum corresponding to a single biological polymer molecule of interest.

12. The method of claim 11, wherein the step of selecting the plurality of ion species further includes:

determining, for each of a plurality of candidate ion species, whether an interfering species is present within a separation window; and, selecting for the plurality of ion species only those of the candidate ion species for which an interfering species is not present.

13. The method of claim 1, wherein the step of concurrently isolating the plurality of ion species includes setting isolation windows of sufficient width to isolate multiple isotopic forms of each ion species.

14. The method of claim 1, wherein the single biological polymer molecule is an intact protein.

15. The method of claim 1, wherein the single biological polymer is an oligonucleotide.

16. A mass spectrometer, comprising:

an ion source for generating sample ions from a sample;

an ion trap or quadrupole mass filter ion isolator configured to concurrently isolate multiple ion species of the sample ions to generate precursor ions;

a mass analyzer for mass analyzing the precursor ions or product ions derived therefrom; and a controller, coupled to the ion isolator, adapted to select ion species corresponding to different charge states of a single biological polymer molecule in the sample, and to cause the ion isolator to concurrently isolate the selected ion species.

17. The mass spectrometer of claim 16, further comprising an ion fragmenter for producing product ions by dissociation of the precursor ions.

18. The mass spectrometer of claim 16, wherein the ion isolator comprises an ion trap and an isolation waveform generator for applying a multi-notch isolation waveform to one or more electrodes of the ion trap.

19. The mass spectrometer of claim 16, wherein the ion isolator comprises a quadrupole mass filter and an isolation waveform generator for applying a multi-notch isolation waveform to one or more electrodes of the quadrupole mass filter.

* * * * *